US007488055B2

(12) United States Patent
Kawashima

(10) Patent No.: US 7,488,055 B2
(45) Date of Patent: Feb. 10, 2009

(54) METHOD AND APPARATUS FOR IMAGE FORMING USING AN INK-JET PRINTING SYSTEM

(75) Inventor: Yashuhiro Kawashima, Kanagawa-ken (JP)

(73) Assignee: Ricoh Company, Ltd, Tokyo (JP)

( * ) Notice: Subject to any disclaimer, the term of this patent is extended or adjusted under 35 U.S.C. 154(b) by 345 days.

(21) Appl. No.: 11/438,719

(22) Filed: May 22, 2006

(65) Prior Publication Data

US 2006/0209099 A1 Sep. 21, 2006

Related U.S. Application Data

(63) Continuation of application No. 10/810,227, filed on Mar. 26, 2004, now Pat. No. 7,077,495.

(30) Foreign Application Priority Data

Mar. 27, 2003 (JP) ..... 2003-086685

(51) Int. Cl.
*B41J 2/14* (2006.01)

(52) U.S. Cl. ..... 347/49

(58) Field of Classification Search ..... 347/29, 347/32, 37, 49

See application file for complete search history.

(56) References Cited

U.S. PATENT DOCUMENTS 4,446,790 A 5/1984 Konkel et al.
4,468,144 A 8/1984 McMahon et al.
4,728,970 A * 3/1988 Terasawa ..... 347/30
5,260,724 A * 11/1993 Tomii et al. ..... 347/32
5,493,365 A 2/1996 Matsui et al.
5,497,250 A 3/1996 Kawashima
5,504,590 A 4/1996 Kawada et al.
5,610,725 A 3/1997 Kawada et al.
5,764,371 A 6/1998 Kawashima et al.
5,805,183 A 9/1998 Lidke et al.
5,883,647 A * 3/1999 Uchida ..... 347/29

(Continued)

FOREIGN PATENT DOCUMENTS

JP 5-193226 8/1993

(Continued)

OTHER PUBLICATIONS

Jun. 11, 2004 Communication and European Search Report in connection with European Application No. EP 04 00 5017 which corresponds to the above-identified application.

(Continued)

*Primary Examiner*—Anh T. N. Vo
(74) *Attorney, Agent, or Firm*—Cooper & Dunham, LLP

(57) ABSTRACT

An ink-jet printing system includes an ink carriage, an ink-jet print head, a guiding member and a supporting member. The ink carriage is detachably provided to the ink-jet printing system. The ink-jet print head is mounted on the ink carriage. The guiding member is configured to support the ink carriage at operational positions of the ink carriage including a home position. The guiding member is also configured to be disengaged from the ink carriage to replace the ink carriage. The supporting member is arranged at a position under the ink carriage at the home position to receive the ink carriage when the guiding member is disengaged from the ink carriage at the home position.

12 Claims, 5 Drawing Sheets

U.S. PATENT DOCUMENTS

| | | | | |
|---|---|---|---|---|
| 5,907,343 | A | 5/1999 | Takemura et al. | |
| 5,996,990 | A | 12/1999 | Kawashima | |
| 6,005,687 | A | 12/1999 | Kawashima et al. | |
| 6,010,204 | A | 1/2000 | Morioka et al. | |
| 6,067,170 | A | 5/2000 | Kawashima et al. | |
| 6,128,107 | A | 10/2000 | Kawashima | |
| 6,147,781 | A | 11/2000 | Tanaka et al. | |
| 6,182,964 | B1 | 2/2001 | Tanaka et al. | |
| 6,311,973 | B1 | 11/2001 | Tanaka et al. | |
| 6,523,931 | B1 * | 2/2003 | Cipolla et al. | 347/30 |
| 7,077,495 | B2 * | 7/2006 | Kawashima | 347/29 |
| 2003/0016271 | A1 | 1/2003 | Maki et al. | |

FOREIGN PATENT DOCUMENTS

| | | |
|---|---|---|
| JP | 6-297725 | 10/1994 |
| JP | 7-47672 | 2/1995 |
| JP | 8-318621 | 12/1996 |
| JP | 9-286119 | 11/1997 |
| JP | 2001-158088 | 6/2001 |
| JP | 2001-180072 | 7/2001 |
| JP | 2002-36597 | 2/2002 |

OTHER PUBLICATIONS

Apr. 15, 2008 Japanese official action in connection with corresponding Japanese patent application No. 2003-086685.

* cited by examiner

METHOD AND APPARATUS FOR IMAGE FORMING USING AN INK-JET PRINTING SYSTEM

CROSS-REFERENCE TO RELATED APPLICATION

This application is a Rule 1.53(b) Continuation of U.S. Ser. No. 10/810,227, filed Mar. 26, 2004, now U.S. Pat. No. 7,077,495, the entire contents of which are incorporated by reference herein.

BACKGROUND

1. Field

This patent specification describes a method and apparatus for image forming, and more particularly to a method and apparatus for image forming using an ink-jet printing system capable of easily replacing an ink carriage including an ink-jet print head.

2. Discussion of the Background

Ink-jet printing systems are commonly used in various image forming apparatuses such as printing machines, facsimile machines, copying machines, MFP (multifunction peripheral) machines and the like. Generally, a background ink-jet printing system includes an ink carriage and an ink-jet print head. The ink-jet print head includes a plurality of nozzles formed on a surface thereof and is mounted on the ink carriage. The ink-jet print head is mounted on the ink carriage. When a recording medium is conveyed to a printing area of the ink-jet printing system, a surface of the ink-jet print head faces a surface of the recording medium. At this time, a predetermined gap is provided between the ink-jet print head and the recording medium. When the background ink-jet printing system performs an image forming operation, the ink carriage slidably travels from side to side of the recording medium. At this time, the ink-jet print head sprays ink drops through the plurality of nozzles directly onto the surface of the recording medium.

The background ink-jet printing system generally employs one of two structures for supplying ink. In one structure, the ink carriage integrally mounting the ink-jet print head and an ink container thereon reciprocally moves from side to side of the recording medium. In the other structure, the ink-jet print head is mounted on the ink carriage and the ink container is fixedly provided to the background ink-jet printing system, and ink is supplied through a tube arranged to connect the ink-jet print head and the ink container.

The ink-jet print head provided to the background ink-jet printing system may be detachably removable with respect to the ink carriage. The ink-jet print head as described above can easily be replaced by an end user, and at a same time, an accurate positioning is required for the plurality of nozzles formed on the ink-jet print head. Further, the background ink-jet printing system may include an ink-jet print head unit which integrally supports a plurality of ink-jet print heads. The ink-jet print head unit is detachably mounted on the ink carriage and is required to accurately be positioned in the event of the replacement thereof. To increase the above-described positioning accuracy, improved structures of the ink-jet print head and the ink carriage have been proposed.

In addition, the ink carriage with the ink-jet print head mounted thereon is slidably supported by a guiding shaft provided to the background ink-jet printing system such that the ink carriage can reciprocally move along the guiding shaft. When the ink carriage is provided in an ink cartridge, the ink carriage reciprocally moves along a longitudinal direction of the ink cartridge.

Referring to FIG. 1, a structure of a background ink-jet printing system 1 is explained. The background ink-jet printing system 1 of FIG. 1 is viewed from a surface side of a recording medium in a printing area. The background ink-jet printing system 1 includes an ink carriage 2, a guiding shaft 3, a plurality of ink-jet print heads 4*a*, 4*b*, 4*c* and 4*d*, and a plurality of nozzles having end nozzles 5*a*, 5*b*, 5*c* and 5*d*. The ink carriage 2 reciprocally moves along the guiding shaft 3 in a direction as indicated by an arrow shown in FIG. 1. The plurality of ink-jet print heads 4*a*, 4*b*, 4*c* and 4*d* are integrally mounted on the ink carriage 2. The plurality of ink-jet print heads 4*a*, 4*b*, 4*c* and 4*d* include the plurality of nozzles having end nozzles 5*a*, 5*b*, 5*c* and 5*d*, respectively, on each predetermined side thereof. It is desirable the end nozzles 5*a*, 5*b*, 5*c* and 5*d* are positioned at equal distances from a shaft line 3*a* which is a line extending in a longitudinal direction of the guiding shaft 3. In FIG. 1, the end nozzles 5*a*, 5*b*, 5*c* and 5*d* are variably positioned on the ink-jet print heads 4*a*, 4*b*, 4*c* and 4*d*, respectively. The end nozzles 5*a* and 5*d* are disposed at positions equally away from the shaft line 3*a* and their distance from the shaft line 3*a* is shortest among the end nozzles 5*a*, 5*b*, 5*c* and 5*d*. The distance between each of the end nozzles 5*a* and 5*d* and the shaft line 3*a* is defined as a distance Y1. The end nozzle 5*b* is disposed at a position furthest away from the shaft line 3*a* and a distance between the end nozzle 5*b* and the shaft line 3*a* is defined as a distance Y2. The end nozzle 5*c* is disposed at a position between the distances Y1 and Y2. A difference between the distances Y1 and Y2 is defined as a distance Y3. When an amount of the distance Y3 is closer to zero, the end nozzles 5*a*, 5*b*, 5*c* and 5*d* are determined to be desirably positioned. Further, it is desirable angles θ1, θ2, θ3 and θ4 of respective nozzle lines 6*a*, 6*b*, 6*c* and 6*d* are right angle with respect to the shaft line 3*a*. Additionally, a distance between the nozzle lines 6*a* and 6*b* is defined as a distance X1, a distance between the nozzle lines 6*b* and 6*c* is defined as a distance X2, and a distance between the nozzle lines 6*c* and 6*d* is defined as a distance X3. It is desirable the distances X1, X2 and X3 are set to a predetermined value. As described above, when positions between the ink carriage 2 and each of the plurality of ink-jet print heads 4*a*, 4*b*, 4*c* and 4*d* are adjusted, positions between the guiding shaft 3 and each of the end nozzles 5*a*, 5*b*, 5*c* and 5*d* need to be fixedly adjusted and positioned. The adjustments as described above can increase an accuracy of replacement of the ink carriage 2 and obtain a high quality image.

However, the background ink-jet printing system 1 of FIG. 1 employs a structure in which the plurality of ink-jet print heads 4*a*, 4*b*, 4*c* and 4*d* are detachably removable with respect to the ink carriage 2. This structure requires high component reliabilities of the ink carriage 2 and the plurality of ink-jet print heads 4*a*, 4*b*, 4*c* and 4*d* for positioning, and high positioning accuracies of the plurality of ink-jet print heads 4*a*, 4*b*, 4*c* and 4*d* with respect to the plurality of respective nozzles having the end nozzles 5*a*, 5*b*, 5*c* and 5*d*. These requirements of the high positioning decrease a positioning accuracy of the plurality of nozzles having the end nozzles 5*a*, 5*b*, 5*c* and 5*d* with respect to the guiding shaft 3. Therefore, a high quality image can hardly be obtained.

Referring to FIG. 2, another case of replacing the components of the background ink-jet printing system 1 is explained. As previously described, the ink carriage 2 is slidably supported by-the guiding shaft 3 of the background ink-jet printing system 1. Two side plates 7 and 8 are provided at both ends of the guiding shaft 3 for supporting the guiding shaft 3 holding it through holes formed on respective surfaces of the side plates 7 and 8. An ink-jet print head cleaning mechanism 9 is provided to a position under the ink carriage 2 for cleaning the ink-jet print heads 4*a*, 4*b*, 4*c* and 4*d* of FIG. 1. A cap (not shown) may also be provided to a position under the ink carriage 2 for keeping the ink-jet print heads 4*a*, 4*b*, 4*c* and 4*d* moist.

When detaching an entire unit of the ink carriage 2 with the plurality of the ink-jet print heads 4*a*, 4*b*, 4*c* and 4*d* mounted thereon from the ink-jet printing system 1, an operator performing the replacement firstly removes retaining rings (not shown) from both ends of the guiding shaft 3 and then pulls out the guiding shaft 3, in a direction indicated by an arrow, from the holes on the side plates 7 and 8 and the ink carriage 2. At this time, the operator needs to hold the ink carriage 2 to prevent it from falling when the guiding shaft 3 no longer supports the ink cartridge 2. In a case where the ink carriage 2 falls, the fall may cause damages on a surface of the ink-jet print heads 4*a*, 4*b*, 4*c* and 4*d*, and damages to the cap and the ink-jet print head cleaning mechanism 9. Further, the operator needs to hold a new ink-jet carriage when attaching it to the ink-jet printing system 1. This may cause the damages as described above and reduce an operability of the replacement.

SUMMARY

The present patent specification describes a novel ink-jet printing system that eliminates the above-described conditions.

In one exemplary embodiment, a novel ink-jet printing system includes an ink carriage, an ink-jet print head, a guiding member and a supporting member. The ink carriage is detachably provided to the ink-jet printing system. The ink-jet print head is mounted on the ink carriage. The guiding member is configured to support the ink carriage at operational positions of the ink carriage including a home position and is also configured to be disengaged from the ink carriage to replace the ink carriage. The supporting member is arranged at a position under the ink carriage at the home position to receive the ink carriage when the guiding member is disengaged from the ink carriage at the home position.

The supporting member may include a horizontal surface and a vertical surface, the horizontal surface having a first predetermined gap from a bottom surface of the ink carriage at the home position and receiving the bottom surface of the ink carriage when the guiding member is disengaged from the ink carriage and the vertical surface having a second predetermined gap from a side surface of the ink carriage when the horizontal surface receives the bottom surface of the ink carriage.

The above-described ink-jet printing system may further include a sealing member configured to be lifted to seal the ink-jet print head and movably mounted at a position under the ink carriage at the home position with a third predetermined gap from the ink-jet print head greater than the first predetermined gap between the ink carriage and the horizontal surface of the supporting member.

The above-described ink-jet printing system may further include a positioning member configured to stop horizontal movements of the ink carriage from the home position.

The positioning member may be configured to be lifted to a first predetermined position.

The positioning member may also be engaged at the predetermined position with a positioning detent formed on a bottom side of the ink carriage.

The supporting member may include a frame receptacle configured to be lifted to a second predetermined position.

The supporting member may include a first supporting member including a U-shaped member fixedly provided to the ink-jet printing system for holding the ink carriage when the guiding member is disengaged from the ink carriage at the home position, and a second supporting member including a plate-like member configured to be lifted to a third predetermined position for stopping horizontal movements of the ink carriage from the home position when the guiding member is disengaged from the ink carriage at the home position.

This patent specification also describes, in one embodiment, a novel method of manufacturing an ink-jet printing system which includes the steps of mounting an ink carriage including an ink-jet print head to the ink-jet printing system, applying a guiding member configured to support the ink carriage at operational positions of the ink carriage including a home position and to be disengaged from the ink carriage to replace the ink carriage, and installing a supporting member arranged at a position under the ink carriage at the home position to receive the ink carriage when the guiding member is disengaged from the ink carriage at the home position.

The above-described method of manufacturing an ink-jet printing system may further include the step of mounting a sealing member configured to be lifted to seal the ink-jet print head and mounted at a position under the ink carriage at the home position with a third predetermined gap from the ink-jet print head greater than first predetermined gap between the ink carriage and the horizontal surface of the supporting member.

The above-described method of manufacturing an ink-jet printing system may further include the step of providing a positioning member configured to stop horizontal movements of the ink carriage from the home position.

The above-described method of manufacturing an ink-jet printing system may further include the steps of installing a first supporting member including a U-shaped member fixedly provided to the ink-jet printing system for holding the ink carriage when the guiding member is disengaged from the ink carriage at the home position, and mounting a second supporting member including a plate-like member configured to be lifted to a third predetermined position for stopping horizontal movements of the ink carriage from the home position when the guiding member is disengaged from the ink carriage at the home position.

Further, in one embodiment, a novel ink-jet printing system includes an ink-jet carriage, an ink-jet print head, a guiding member, and a sealing unit. The ink carriage is detachably provided to the ink-jet printing system. The ink-jet print head is mounted on the ink carriage. The guiding member is configured to support the ink carriage at operational positions of the ink carriage including a home position and is also configured to be disengaged from the ink carriage to replace the ink carriage. The sealing unit integrally includes a frame and a sealing member. The frame includes a supporting member arranged at a position under the ink carriage at the home position to receive the ink carriage when the guiding member is disengaged from the ink carriage at the home position. The sealing member is configured to be lifted to seal the ink-jet print head and is movably mounted to the frame at a position under the ink carriage at the home position with a predetermined gap from the ink-jet print head greater than another predetermined gap between the ink carriage and a horizontal surface of the supporting member contacting the ink carriage.

This patent specification also describes, in one embodiment, a novel method of manufacturing an ink-jet printing system which includes the steps of mounting an ink carriage including an ink-jet print head to the ink-jet printing system, applying a guiding member configured to support the ink carriage at operational positions of the ink carriage including a home position and to be disengaged from the ink carriage to replace the ink carriage, and installing a sealing unit which integrally comprises a frame including a supporting member arranged at a position under the ink carriage at the home position to receive the ink carriage when the guiding member is disengaged from the ink carriage at the home position and a sealing member configured to be lifted to seal the ink-jet print head and movably mounted at a position under the ink carriage at the home position with a predetermined gap from the ink-jet print head greater than another predetermined gap between the ink carriage and a horizontal surface of the supporting member contacting the ink carriage.

In one exemplary embodiment, a novel image forming apparatus includes a housing and an ink-jet printing system. The ink-jet printing system includes an ink carriage, an ink-jet print head, a guiding member and a supporting member. The ink carriage is detachably provided to the ink-jet printing system. The ink-jet print head is mounted on the ink carriage. The guiding member is configured to support the ink carriage at operational positions of the ink carriage including a home position and is also configured to be disengaged from the ink carriage to replace the ink carriage. The supporting member is arranged at a position under the ink carriage at the home position to receive the ink carriage when the guiding member is disengaged from the ink carriage at the home position.

In one exemplary embodiment, a novel image forming apparatus includes a housing and an ink-jet printing system. The ink-jet printing system includes an ink carriage, an ink-jet print head, a guiding member and a sealing unit. The ink carriage is detachably provided to the ink-jet printing system. The ink-jet print head mounted on the ink carriage. The guiding member is configured to support the ink carriage at operational positions of the ink carriage including a home position and is also configured to be disengaged from the ink carriage to replace the ink carriage. The sealing unit integrally includes a frame and a sealing member. The frame includes a supporting member arranged at a position under the ink carriage at the home position to receive the ink carriage when the guiding member is disengaged from the ink carriage at the home position. The sealing member is configured to be lifted to seal the ink-jet print head and is movably mounted to the frame at a position under the ink carriage at the home position with a predetermined gap from the ink-jet print head greater than another predetermined gap between the ink carriage and a horizontal surface of the supporting member contacting the ink carriage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
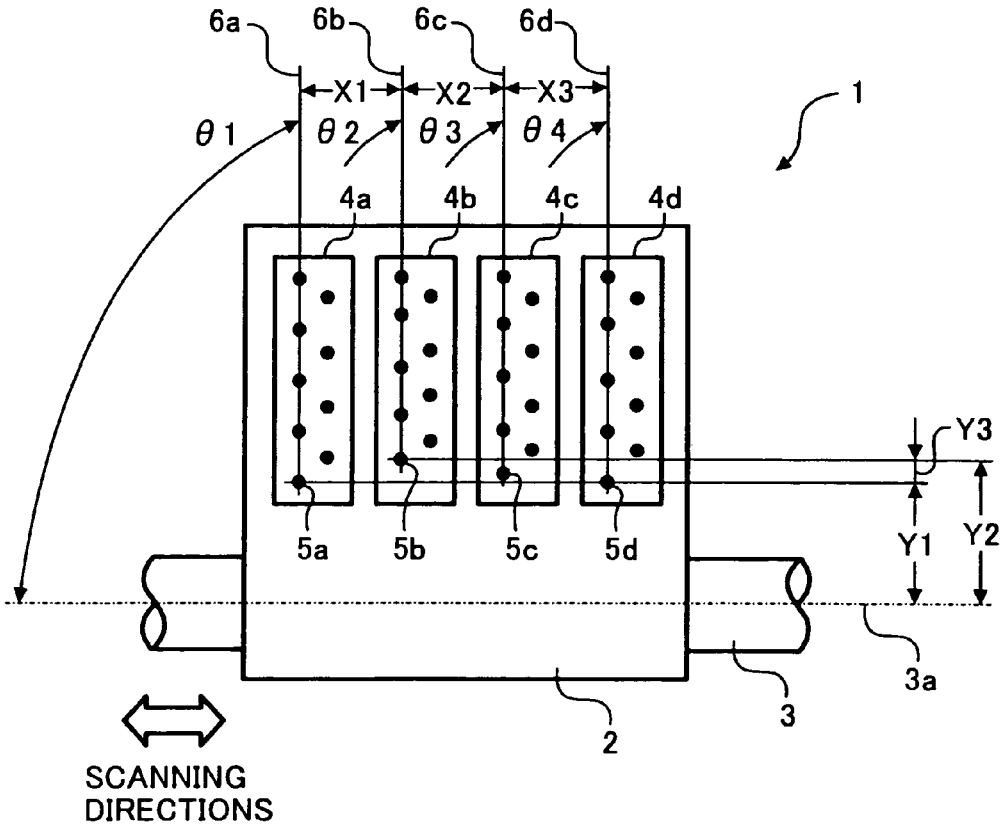
FIG. 1 PRIOR ART
FIG. 1 is an illustration showing a structure of a background ink-jet printing system, focusing on an ink carriage viewed from a side of a surface of a recording medium conveyed to a printing area.
Figure 2:
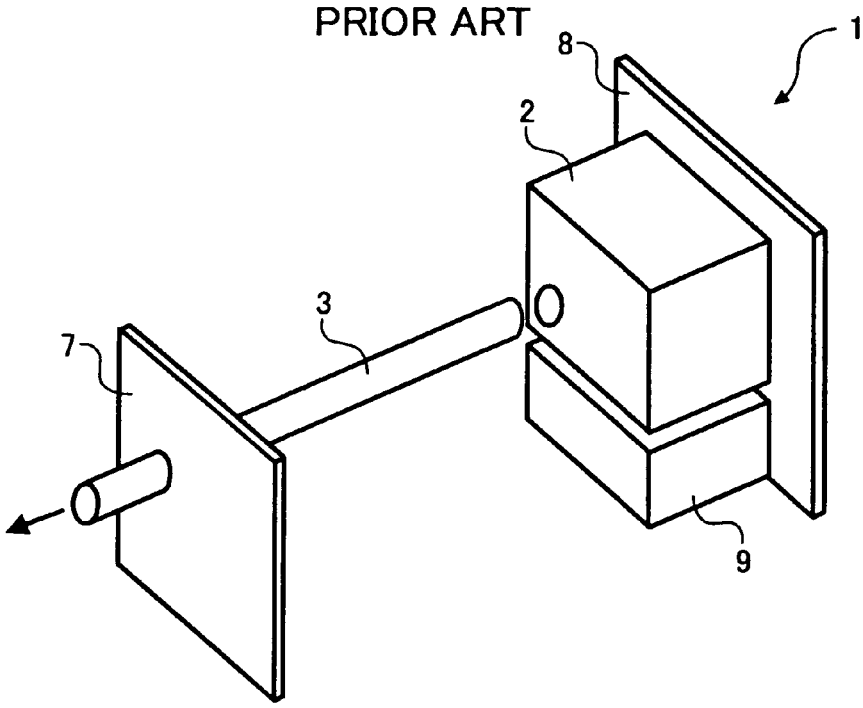
FIG. 2 PRIOR ART
FIG. 2 is a schematic illustration of a larger part of the background ink-jet printing system of FIG. 1.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 3:
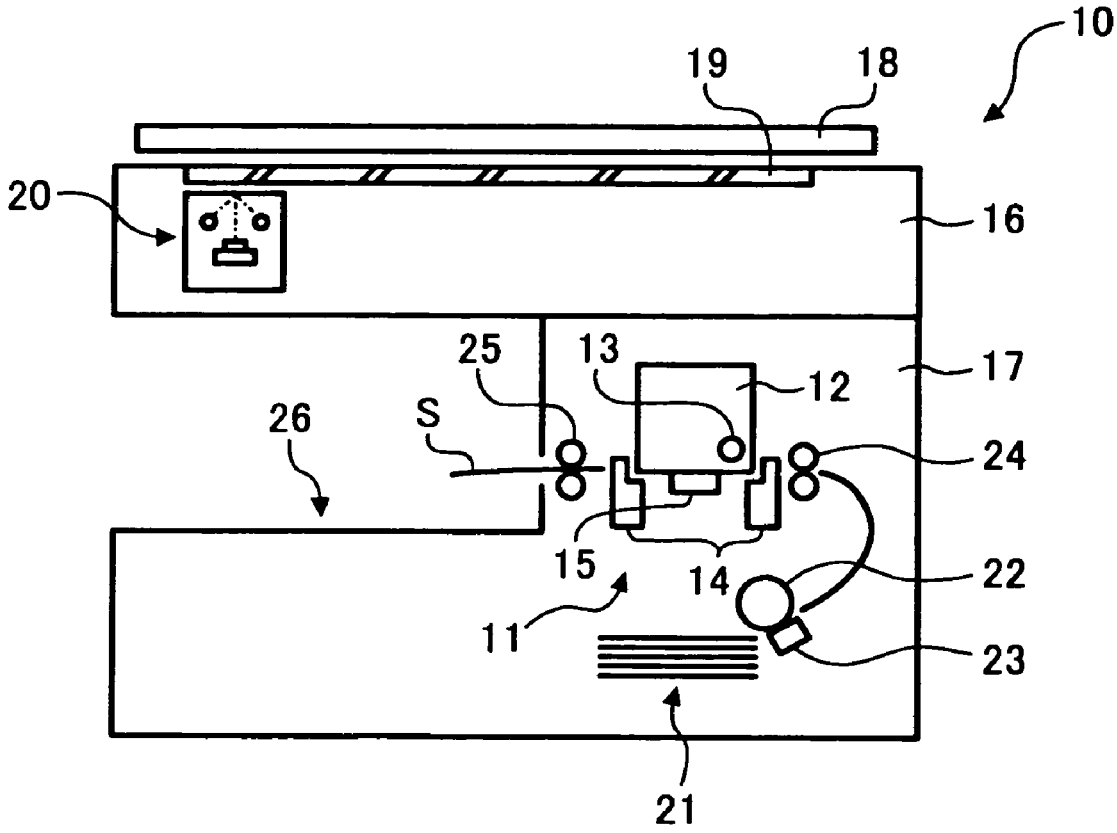
FIG. 3 is an illustration of an image forming apparatus in which an ink-jet printing system of the present patent specification is included.

Referring now to the drawings, wherein like reference numerals designate identical or corresponding parts throughout the several views, and particularly to FIG. 3, a structure of an ink-jet printing system 10 is explained according to an exemplary embodiment of the present patent specification.

Referring now to FIG. 3, a schematic structure of an image forming apparatus 10 including an ink-jet printing system 11 is explained. A front side of the image forming apparatus 10 is shown in the left side of FIG. 3. The image forming apparatus 10 may form an electrophotographic copying machine, a MFP machine and the like. The ink-jet printing system 11 according to the present patent specification includes an ink carriage 12, a guiding shaft 13, a supporting member 14 and an ink-jet print head 15.

In FIG. 3, the image forming apparatus 10 includes a reading portion 16 and a writing portion 17. The reading portion 16 includes a cover plate 18, a contact glass 19 and a reading unit 20. The writing portion 17 includes a sheet cassette 21, a sheet feeding roller 22, a sheet separation pad 23, a pair of conveyance rollers 24, a pair of discharging rollers 25, an output sheet tray 26, and the ink-jet printing system 11.

When a user performs a copying operation of an original document, the user places the original document having an image thereon on the contact glass 19 and lowers the cover plate 18 to cover the original document on the contact glass 19 so that the reading unit 20 can correctly read the image. In the writing portion 17, a recording sheet S which is placed on a top of recording sheets accommodated in the sheet cassette 21 is fed by the sheet feeding roller 22, is separated from the other recording sheets in the sheet cassette 21 by the sheet separation pad 23, and is conveyed by the pair of conveyance rollers 24 to the ink-jet printing system 11. In the ink-jet printing system 11 which is provided to a portion between the pair of conveyance rollers 24 and the pair of discharging rollers 25 of the image forming apparatus 10, the ink carriage 12 moves along the guiding shaft 13 to reproduce the image on a surface of the recording sheet S. The recording sheet S having the image thereon is discharged by the pair of discharging rollers 25 to the output sheet tray 26.

Figure 4:
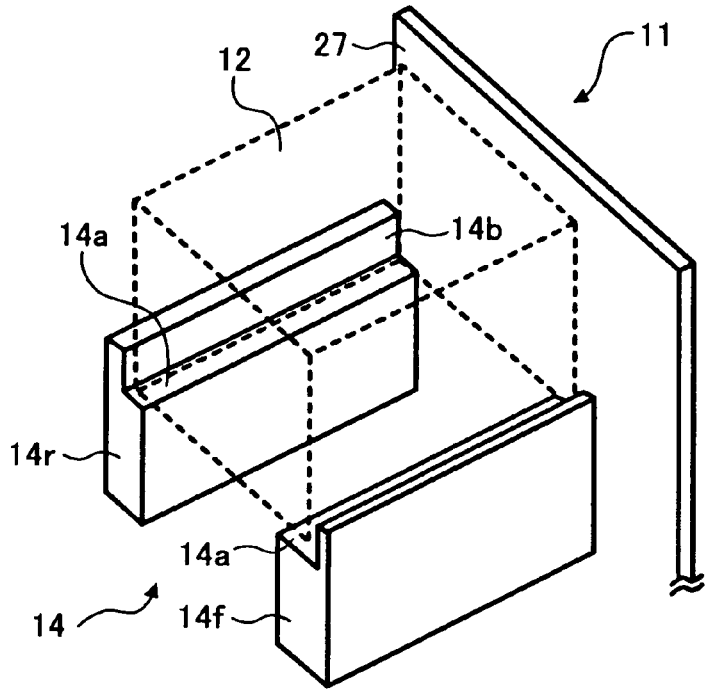
FIG. 4 is an illustration of a structure of an ink-jet printing system of an exemplary embodiment according to the present patent specification.

Referring now to FIG. 4, a structure of the ink-jet printing system 11 of FIG. 3 is explained. FIG. 4 shows that the ink carriage 12 is located at a replacement standby position which is also referred to as a home position.

The ink-jet printing system 11 further includes a side plate 27 in addition to the ink carriage 12, the supporting member 14 and the ink-jet print head 15.

The ink carriage 12 having an ink-jet print head (not shown) mounted thereon is supported by the guiding shaft 13 of FIG. 3 and is guided such that the ink carriage 12 slidably reciprocates along the guiding shaft 13.

The side plate 27 supports the guiding shaft 13.

The supporting member 14 includes a pair of plates 14*f* and 14*r*, each having a step on a top thereof. The pair of plates 14*f* and 14*r* are arranged at the replacement standby position for the ink carriage 12 in parallel to each other as shown in FIG. 4 such that the vertical surfaces of the steps face each other. The pair of plates of the supporting member 14 are provided perpendicular to the side plate 27 and parallel to the guiding shaft 13. Each of the plates of the supporting member 14 includes a supporting surface 14*a* extending horizontally and a side wall 14*b* having a vertical surface. The guiding shaft 13 supports the ink carriage 12 and two predetermined gaps are formed between the ink carriage 12 and the supporting surface 14*a* and between the ink carriage 12 and the side wall 14*b* so that the ink carriage 12 can smoothly move along the guide shaft 13.

The ink-jet print head 15 is mounted on the ink carriage 12 and has a plurality of nozzles thereon.

In a replacing operation of the ink carriage 12, an operator operates the image forming apparatus 10 of FIG. 3 to issue instructions to the ink-jet printing system 11 for moving the ink carriage 12 to the replacement standby position under which the supporting member 14 is provided. As previously described, the ink carriage 12 has the predetermined gaps with respect to the supporting surface 14*a* and the side wall 14*b* of the supporting member 14, and the ink carriage 12 can thereby smoothly move to the replacement standby position. The operator then pulls out the guiding shaft 13 from the ink carriage 12. At this time, the supporting member 14 of this embodiment holds the ink carriage 12 on the supporting surface 14*a* thereof so that the ink carriage 12 may not fall onto a portion of a mechanism included in the ink-jet printing system 10 of FIG. 3 and may not cause a damage to the ink-jet print head or another component in the replacement of the ink carriage 12.

Figure 5:
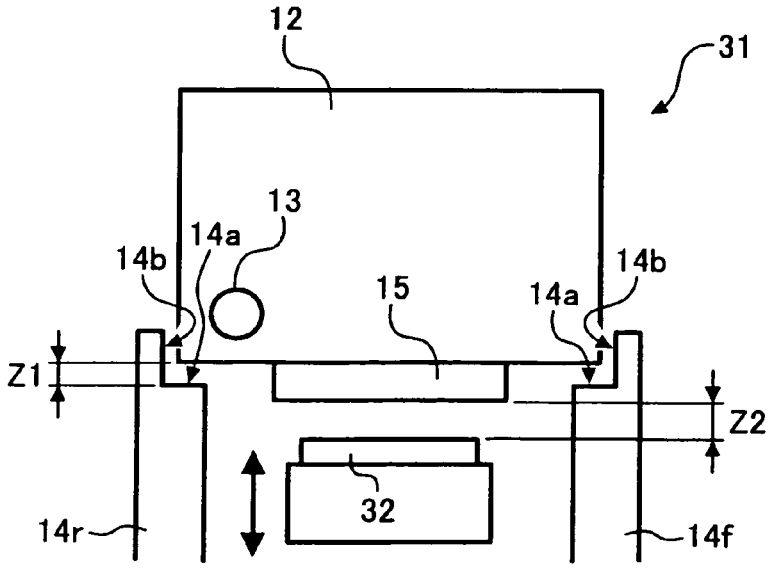
FIG. 5 is an illustration of another structure of an ink-jet printing system of another exemplary embodiment according to the present patent specification.

Referring to FIG. 5, a structure of an ink-jet printing system 31 is explained according to another exemplary embodiment of the present patent specification. A front side of the ink-jet printing system 31 is shown in the right side of FIG. 5. FIG. 5 shows the ink carriage is located at the replacement standby position. The ink-jet printing system 31 is applied to the image forming apparatus 10 of FIG. 3.

The ink-jet printing system 31 of FIG. 5 includes the ink carriage 12, the guiding shaft 13, the supporting member 14, the ink-jet print head 15, and a cap 32. The supporting member 14 includes a pair of plates 14*f* and 14*r*, each having a step on a top thereof. Each of the pair of plates 14*f* and 14*r* includes the supporting surface 14*a* extending horizontally and the side wall 14*b* having a vertical surface. The ink-jet printing system 31 is similar to the ink-jet printing system 11, except for the cap 32.

The cap 32 is provided to a position below the ink carriage 12 to face up to the ink-jet print head 15 and is movable in a vertical direction. When a printing operation is not performed, the cap 32 moves to a predetermined upward position so that a surface of the cap 32 contacts the ink-jet print head 15 for sealing a surface of the ink-jet print head 15 to prevent the ink-jet print head 15 from dryness. When the printing operation is performed, the cap 32 moves from the ink-jet print head 15 to a predetermined downward position so that the ink carriage 12 can smoothly move along the guiding shaft 13 for performing the printing operation.

As previously described, the ink carriage 12 has a predetermined gap with respect to the supporting surface 14*a*. This predetermined gap between the ink carriage 12 and the supporting surface 14*a* is defined as a distance Z1, as shown in FIG. 5. The surface of the ink-jet print head 15 is separated from the surface of the cap 32 by another predetermined gap when the printing operation is not performed. This predetermined gap between the surface of the ink-jet print head 15 and the surface of the cap 32 is defined as a distance Z2, as shown in FIG. 5. The ink-jet printing system 31 of this embodiment is configured to set the ink carriage 12 such that an amount of the distance Z1 is smaller than an amount of the distance Z2. Accordingly, when the guiding shaft 13 is pulled out from the ink carriage 12, the supporting surface 14*a* of the supporting member 14 can hold the ink carriage 12, without the ink-jet print head 15 colliding with the cap 32. Therefore, a damage to the ink-jet print head 15 and the cap 32 may be avoided.

Figure 6A:
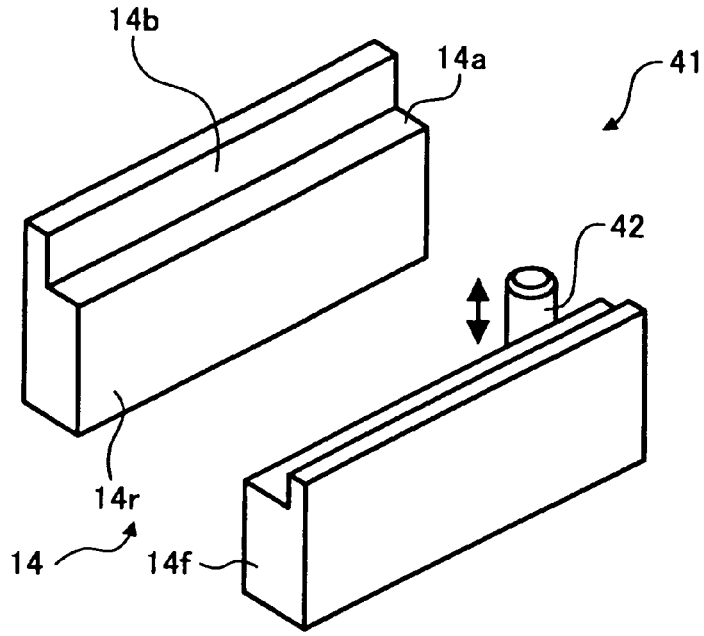
FIG. 6A is an illustration of a structure of a supporting member included in an ink-jet printing system of an exemplary embodiment according to the present patent specification and FIG. 6B is another illustration of the structure of the supporting member, a part of which showing a sectional view thereof.
Figure 6B:
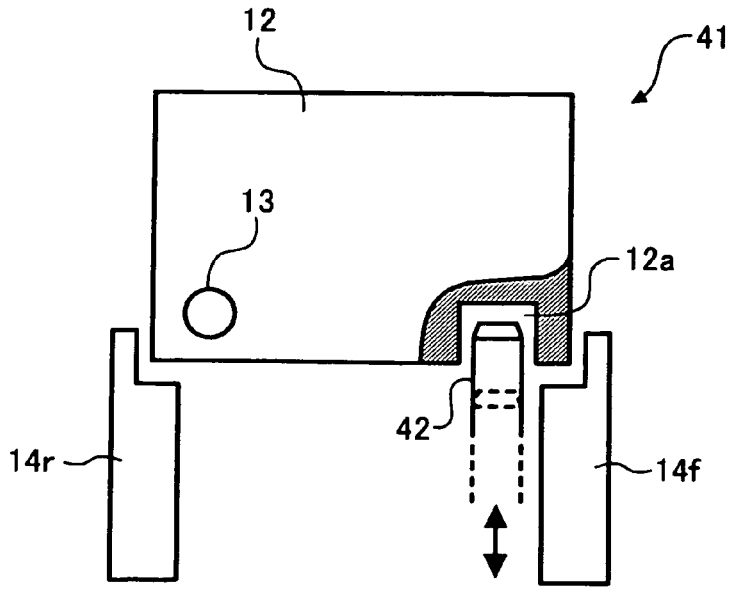

Referring to FIGS. 6A and 6B, structures of the supporting member 14 included in ink-jet printing system 41 are explained according to another exemplary embodiment of the present patent specification. A front side of the ink-jet printing system 41 is shown in the right side of FIG. 6B. FIG. 6B shows the ink carriage 12 is located at the replacement standby position. The ink-jet printing system 41 is applied to the image forming apparatus 10 of FIG. 3.

The ink-jet printing system 41 of FIGS. 6A and 6B includes the ink carriage 12, the guiding shaft 13, the supporting member 14 having the supporting surface 14*a* and the side wall 14*b*, and a positioning pin 42. FIG. 6B partially shows a sectional view of a positioning detent 12*a* of the ink carriage 12. The ink-jet printing system 41 is similar to the ink-jet printing system 11, except for the positioning pin 42 and the positioning detent 12*a*.

As shown in FIG. 6A, the positioning pin 42 is provided to a position in a vicinity of one of the two plates of the supporting member 14 and is movable in a vertical direction. The positioning pin 42 usually stays at a predetermined downward position so that the ink carriage 12 can smoothly perform a printing operation. When the ink carriage 12 arrives at the replacement standby position, the positioning pin 42 moves to a predetermined upward position. At that time, the positioning pin 42 is inserted to the positioning detent 12*a* formed on a bottom side of the ink carriage 12 to support the ink carriage 12, as shown in FIG. 6B. Thus, when the guiding shaft 13 is pulled out for replacing the ink carriage 12, the supporting member 14 may support the ink carriage 12 in a vertical direction and the positioning pin 42 engaging with the positioning detent 12*a* of the ink carriage 12 may support the ink carriage 12 in a horizontal direction. This may prevent the ink carriage 12 from sliding on the supporting member 14 to collide with another component provided to the ink-jet printing system 41 or from falling from the ink-jet printing system 41. Further, a new ink-jet carriage (not shown) may easily be positioned because of a support by the positioning pin 42, and an operability of replacement may thereby be improved.

In this embodiment, the positioning pin 42 is located in the vicinity of one of the two plates of the supporting member 14, as described above. The positioning pin 42, however, may be located at a position other than the position as described above unless movements of the ink carriage 12 and other components provided to the ink-jet printing system 41 are interfered.

In this embodiment, the positioning pin 42 of FIGS. 6A and 6B forms a cylindrical shape. The shape of the positioning pin 42, however, may be any shape including a rectangular column, a triangular pyramid and so on. Further, the operability of replacement may be improved by employing a positioning member used for keeping accurate positions of the ink-jet print head 15 and the cap 32 of FIG. 5, or by employing another positioning member or mechanism used for securing the components during transportation. Consequently, the supporting member 14 of this embodiment may prevent a damage to the ink-jet printing system 41, particularly to the ink-jet print head 15 or the cap 32.

Figure 7:
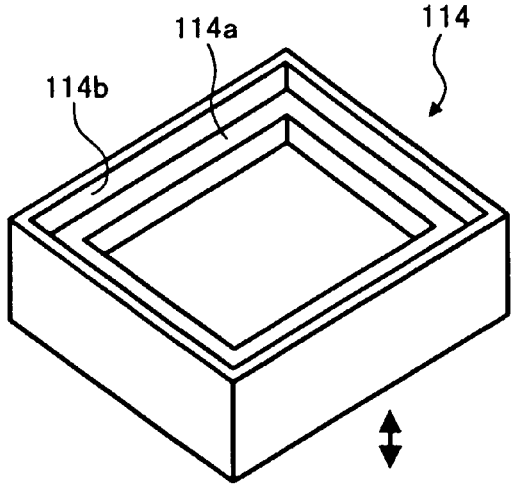
FIG. 7 is an illustration of another structure of a supporting member included in an ink-jet printing system of an exemplary embodiment according to the present patent specification.

Referring to FIG. 7, a structure of a supporting member 114 is explained according to another exemplary embodiment of the present patent specification. The supporting member 114 is applied to the ink-jet printing system 11 of the image forming apparatus 10 of FIG. 3.

The supporting member 114 of FIG. 7 includes a supporting surface 114*a* horizontally extending and a side wall 114*b* having a vertical surface.

As shown in FIG. 7, the supporting member 114 is provided movable in a vertical direction. The supporting member 114 includes a frame receptacle and is configured to move to a predetermined downward position during a printing operation of the ink-jet printing system 11 of FIG. 3. The supporting member 114 is also configured to move to a predetermined upward position to support the ink carriage 12 of FIG. 3 during a replacement of the ink carriage 12. When the ink carriage 12 arrives at the replacement standby position, the supporting member 114 moves to the predetermined upward position to support the ink carriage 12. At this time, the supporting surface 114*a* of the supporting member 114 holds a bottom surface of the ink carriage 12 to regulate a movement of the ink carriage 12 in the vertical direction and the side wall 114*b* of the supporting member 114 regulates a movement of the ink carriage 12 in the horizontal direction. This may prevent the ink carriage 12 from falling from the ink-jet printing system 11 or from sliding on the supporting member 114 and, as a result, may prevent a damage to the ink carriage 12 itself and another component provided to the ink-jet printing system 11.

Figure 8:
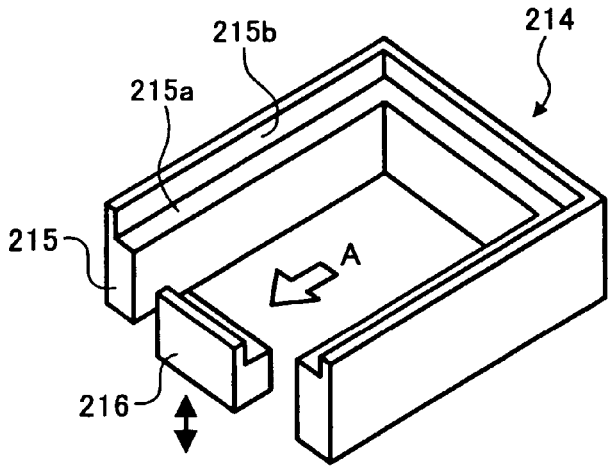
FIG. 8 is an illustration of another structure of a supporting member included in an ink-jet printing system of an exemplary embodiment according to the present patent specification.

Referring now to FIG. 8, a structure of a supporting member 214 is explained according to another exemplary embodiment of the present patent specification. The supporting member 214 is applied to the ink-jet printing system 11 of the image forming apparatus 10 of FIG. 3.

The supporting member 214 is formed by a first supporting member 215 and a second supporting member 216. The first supporting member 215 has a U-shaped form having a step on a top thereof fixedly provided to the ink-jet printing system 11 of FIG. 3 and includes a supporting surface 215*a* horizontally extending and a side wall 215*b* having a vertical surface. The second supporting member 216 is a plate-like form having a step on a top thereof and is provided movable in a vertical direction. The supporting surface 215*a* and the side wall 215*b* of the first supporting member 215 provided to the ink-jet printing system 11 have two predetermined gaps. One predetermined gap is formed between the ink carriage 12 and the supporting surface 215*a* and the other predetermined gap is formed between the ink carriage 12 and the side wall 215*b*. Because of these predetermined gaps, the ink carriage 12 can smoothly move to the replacement standby position. When the ink carriage 12 arrives at the replacement standby position, the second supporting member 216 moves to the predetermined upward position to regulate the ink carriage 12 so that the ink carriage 12 does not move to a direction A as indicated in FIG. 8. Accordingly, the supporting member 214 may prevent a damage to the ink carriage 12 or other components provided to the ink-jet printing system 11.

Figure 9:
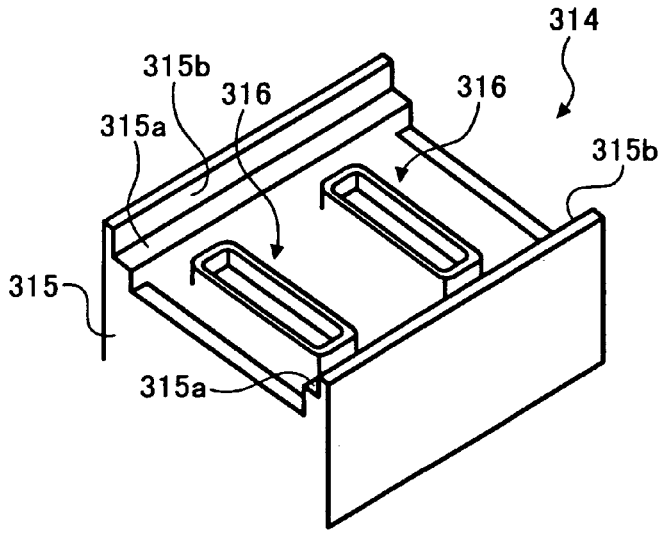
FIG. 9 is an illustration of a capping unit serving as a supporting member included in an ink-jet printing system of an exemplary embodiment according to the present patent specification.

Referring now to FIG. 9, a structure of a capping unit 314 is explained according to another exemplary embodiment of the present patent specification. The capping unit 314 is applied to the ink-jet printing system 11 of the image forming apparatus 10 of FIG. 3.

In FIG. 9, two caps are provided for covering two ink-jet print heads of the ink-jet printing system 11 because one cap is needed per one ink-jet print head. Therefore, the number of the caps may be variable according to the number of the ink-jet print heads.

The capping unit 314 is arranged at a replacement standby position for the ink carriage 12 of FIG. 3 and includes a unit frame 315, and caps 316. The unit frame 315 is a square shaped member which has two protruding sides which stand in parallel to each other, each of the two protruding sides having a step on a top thereof. The caps 316 are surrounded by the unit frame 315 and are arranged movable in a vertical direction. When the ink-jet printing system 11 is not in a printing operation, each of the caps 316 moves to a predetermined upward position and seals a corresponding surface of the ink-jet print head 15 of FIG. 3 to prevent the ink-jet print head 15 from dryness. When the ink-jet printing system 11 is in the printing operation, each of the caps 316 moves to a predetermined downward position to move away from the ink-jet print head 15 for a smooth movement of the ink carriage 12 of FIG. 3.

As described above, the capping unit 314 of this embodiment is arranged at a replacement standby position for the ink carriage 12, the replacement standby position being generally provided both for replacing the ink carriage 12 and for applying the cap 316 to the surface of the ink-jet print head 15. Because of the arrangement, the capping unit 314 may serve as a supporting member when the ink carriage 12 is replaced. The unit frame 315 includes a supporting surface 315*a* extending horizontally and a side wall 315*b* having a vertical surface at each protruding side. Predetermined gaps are provided between the supporting surface 315*a* and the ink carriage 12 and between the side wall 315*b* and the ink carriage 12 so that the ink carriage 12 can smoothly move along the guiding shaft 13 of FIG. 3. During the replacing operation, the ink carriage 12 moves to the replacement standby position. At this time, the supporting surface 315*a* and the side wall 315*b* hold the bottom of the ink carriage 12. When the printing operation is not performed, the ink carriage 12 stays at the replacement standby position and the ink-jet print head 15 is covered by the cap 316. At this time, the cap moves to the predetermined downward position and the supporting surface 315*a* and the side wall 315*b* hold the bottom of the ink carriage 12. Therefore, an operator performing the replacement operation can easily replace the ink carriage without moving the ink carriage itself.

For a further accurate positioning of the cap 316 with respect to the ink-jet print head 15, it is desirable to use a positioning member such as the positioning pin 42 in FIG. 6B.

Further, as previously described in the embodiment with respect to the structure shown in FIG. 5, a fine positioning may be performed when the predetermined gap between the ink carriage 12 and the supporting surface 315*a* is made smaller than the predetermined gap between the surface of the ink-jet print head 15 and the cap 316.

Numerous additional modifications and variations are possible in light of the above teachings. It is therefore to be understood that within the scope of the appended claims, the disclosure of this patent specification may be practiced otherwise than as specifically described herein.

This patent specification is based on Japanese Patent Application, No. 2003-086685 filed on Mar. 27, 2003 in the Japanese Patent Office, the entire contents of which are incorporated by reference herein.

What is claimed is:

1. An apparatus, comprising:

a carriage detachably provided to the apparatus;

a head mounted on the carriage;

a guiding member configured to support the carriage and to be disengaged from the carriage to replace the carriage; and a supporting member arranged at a position under the carriage to receive the carriage when the guiding member is disengaged from the carriage.

2. The apparatus of claim 1, wherein said guiding member supports the carriage at operational positions of the carriage including a home position, and said supporting member receives the carriage when the guiding member is disengaged from the carriage at the home position.

3. The apparatus of claim 1, further comprising:

a sealing unit which integrally comprises:

a frame including said supporting member arranged at said position under the carriage to receive the carriage when the guiding member is disengaged from the carriage; and a sealing member configured to be lifted to seal the head and movably mounted to the frame at a position under the carriage with a predetermined gap from the head greater than another predetermined gap between the carriage and a horizontal surface of the supporting member contacting the carriage.

4. The apparatus of claim 3, wherein said guiding member supports the carriage at operational positions of the carriage including a home position, and said supporting member receives the carriage when the guiding member is disengaged from the carriage at the home position.

5. A method for manufacturing an apparatus, comprising the steps of:

(a) mounting a carriage including a head to the apparatus;

(b) applying a guiding member configured to support the carriage and to be disengaged from the carriage to replace the carriage; and (c) installing a supporting member arranged at a position under the carriage to receive the carriage when the guiding member is disengaged from the carriage.

6. The method of claim 5, further comprising supporting, with said guiding member applied in (b), the carriage at operational positions of the carriage including a home position, and allowing said supporting member, installed in (c) at said position under the carriage, to receive the carriage when the guiding member is disengaged from the carriage at the home position.

7. The method of claim 5, wherein said step (c) includes installing a sealing unit which integrally comprises a frame including said supporting member arranged at said position under the carriage to receive the carriage when the guiding member is disengaged from the carriage and a sealing member configured to be lifted to seal the head and movably mounted at a position under the carriage with a predetermined gap form the head greater than another predetermined gap between the carriage and a horizontal surface of the supporting member contacting the carriage.

8. The method of claim 7, further comprising supporting, with said guiding member applied in (b), the carriage at operational positions of the carriage including a home position, and allowing said supporting member, installed in (c) at said position under the carriage, to receive the carriage when the guiding member is disengaged from the carriage at the home position.

9. An image forming apparatus, comprising:

a housing; and a printing apparatus which comprises, a carriage detachably provided to the printing apparatus;

a head mounted on the carriage;

a guiding member configured to support the carriage and to be disengaged from the carriage to replace the carriage;

a supporting member arranged at a position under the carriage to receive the carriage when the guiding member is disengaged from the carriage.

10. The apparatus of claim 9, wherein said guiding member supports the carriage at operational positions of the carriage including a home position, and said supporting member receives the carriage when the guiding member is disengaged from the carriage at the home position.

11. The image forming apparatus of claim 9, wherein said printing apparatus further comprises;

a sealing unit which integrally comprises:

a frame including said support member arranged at a position under the carriage to receive the carriage when the guiding member is disengaged from the carriage; and a sealing member configured to be lifted to seal the head and movably mounted to the frame at a position tinder the carriage with a predetermined gap from the head greater than another predetermined gap between the carriage and a horizontal surface of the supporting member contacting the carriage.

12. The apparatus of claim 11, wherein said guiding member supports the carriage at operational positions of the carriage including a home position, and said supporting member receives the carriage when the guiding member is disengaged from the carriage at the home position.

* * * * *